US012767466B2

(12) United States Patent
Kawabata

(10) Patent No.: US 12,767,466 B2
(45) Date of Patent: Oct. 20, 2026

(54) MEDIUM CONVEYANCE DEVICE AND IMAGE READING DEVICE

(71) Applicant: SEIKO EPSON CORPORATION, Tokyo (JP)

(72) Inventor: Shinya Kawabata, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 18/890,640

(22) Filed: Sep. 19, 2024

(65) Prior Publication Data

US 2025/0100830 A1 Mar. 27, 2025

(30) Foreign Application Priority Data

Sep. 21, 2023 (JP) ..... 2023-156123

(51) Int. Cl.
*B65H 5/36* (2006.01)
*B65H 5/06* (2006.01)

(52) U.S. Cl.
CPC ..... *B65H 5/062* (2013.01); *B65H 2404/6942* (2013.01); *B65H 2601/521* (2013.01); *B65H 2701/1313* (2013.01); *B65H 2801/39* (2013.01)

(58) Field of Classification Search
CPC ..... B65H 2404/6111; B65H 2404/611; B65H 2404/612; B65H 2404/6942; B65H 2404/694; B65H 5/36; B65H 5/38; B65H 5/062; H04N 1/00615
See application file for complete search history.

(56) References Cited

U.S. PATENT DOCUMENTS

2006/0175748 A1* 8/2006 Machida ..... B65H 5/06 271/264
2012/0224903 A1 9/2012 Honma
2019/0243296 A1* 8/2019 Shiga ..... B65H 5/062
2020/0002113 A1* 1/2020 Yamada ..... B65H 9/006

FOREIGN PATENT DOCUMENTS

JP 2002274731 A * 9/2002
JP 2004032154 A * 1/2004
JP 2004107051 A * 4/2004
JP 2012-180176 A 3/2012

* cited by examiner

*Primary Examiner* — Luis A Gonzalez
(74) *Attorney, Agent, or Firm* — WORKMAN NYDEGGER

(57) ABSTRACT

A medium conveyance device includes a first roller pair and a second roller pair for conveying a medium, a curved path from the first roller pair to the second roller pair, an outer path forming member that forms an outer side of the curved path, an inner path forming member that forms an inner side of the curved path, and at least one flexible guide member that guides the medium in the curved path, one end of the guide member is a fixed end provided at the outer path forming member, the other end of the guide member is a free end located downstream of the fixed end in a conveyance direction, and the inner path forming member has a convex portion that protrudes toward the guide member at a position facing the guide member.

7 Claims, 9 Drawing Sheets

MEDIUM CONVEYANCE DEVICE AND IMAGE READING DEVICE

The present application is based on, and claims priority from JP Application Serial Number 2023-156123, filed Sep. 21, 2023, the disclosure of which is hereby incorporated by reference herein in its entirety.

BACKGROUND

1. Technical Field

The present disclosure relates to a medium conveyance device that conveys a medium, and an image reading device including the medium conveyance device.

2. Related Art

A medium conveyance device disclosed in JP-A-2012-180176 has a configuration in which a medium is curved and reversed and conveyed downstream of a roller pair constituted by an intermediate feed roller and a driven roller.

When a rear end of the medium comes off from a nip between the intermediate feed roller and the driven roller, the medium attempts to return to a straight state and moves downstream while the rear end of the medium comes into strong contact with a member forming the outer side of a curved reversing path, resulting in a concern that contact noise may be generated and a user may feel a sense of incompatibility.

Such a problem becomes more pronounced when the curvature of the curved reversing path is increased to make the device more compact, or when a medium conveyance speed is increased to improve a throughput.

SUMMARY

In order to solve the above-described problem, a medium conveyance device according to the present disclosure is a medium conveyance device including a medium conveyance path for conveying a medium in a conveyance direction, the medium conveyance device including a first roller pair that conveys the medium, a second roller pair that is provided downstream of the first roller pair in the conveyance direction and conveys the medium, a curved path that is a path portion of the medium conveyance path from the first roller pair to the second roller pair and is curved, an outer path forming member that forms an outer side of the curved path, an inner path forming member that forms an inner side of the curved path, and at least one guide member that guides the medium in the curved path and is flexible, in which one end of the guide member is a fixed end provided on the outer path forming member, and the other end of the guide member is a free end located downstream of the fixed end in the conveyance direction, and the inner path forming member has a convex portion that protrudes toward the guide member at a position facing the guide member.

In addition, an image reading device according to the present disclosure includes the medium conveyance device and a reading unit that reads the medium conveyed by the medium conveyance device.

DESCRIPTION OF EMBODIMENTS

Figure 1:
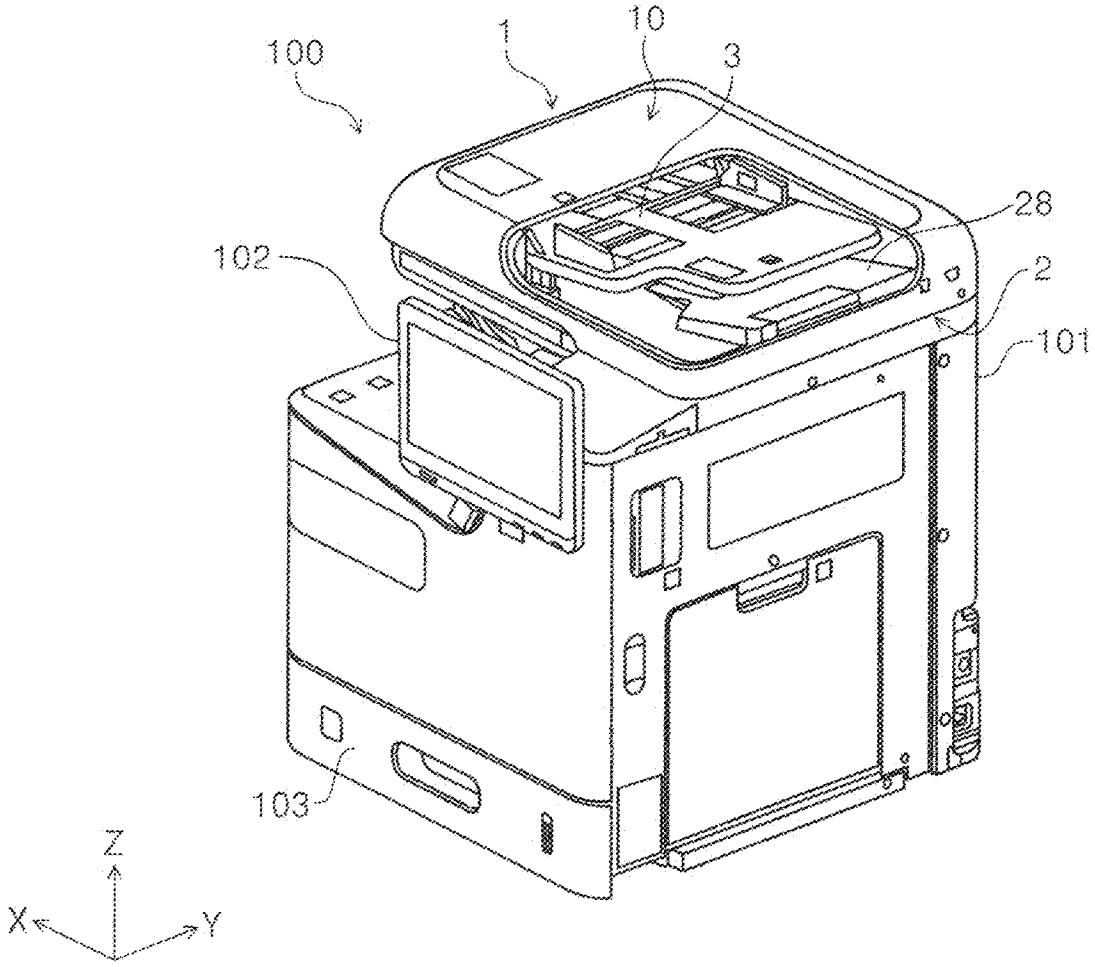
FIG. 1 is an external perspective view of a printer.

The present disclosure will be schematically described below.

A medium conveyance device according to a first aspect is a medium conveyance device including a medium conveyance path for conveying a medium in a conveyance direction, the medium conveyance device including a first roller pair that conveys the medium, a second roller pair that is provided downstream of the first roller pair in the conveyance direction and conveys the medium, a curved path that is a path portion of the medium conveyance path from the first roller pair to the second roller pair and is curved, an outer path forming member that forms an outer side of the curved path, an inner path forming member that forms an inner side of the curved path, and at least one guide member that guides the medium in the curved path and is flexible, in which one end of the guide member is a fixed end provided on the outer path forming member, and the other end of the guide member is a free end located downstream of the fixed end in the conveyance direction, and the inner path forming member has a convex portion that protrudes toward the guide member at a position facing the guide member.

According to this aspect, the guide member can prevent the entire rear end of the medium, that is, the entire rear end in a width direction from coming into strong contact with the outer path forming member when the rear end comes off from the first roller pair, and can suppress contact noise generated due to the rear end coming into strong contact with the outer path forming member.

Here, when the guide member excessively presses the medium toward the inner path forming member, the medium is deformed in a wavy manner in a direction intersecting the conveyance direction, that is, in the width direction, thereby resulting in a concern that the medium cannot be curved smoothly in the curved path. However, the inner path forming member has a convex portion that protrudes toward the guide member at a position facing the guide member, and thus it is possible to prevent the guide member from excessively pressing the medium toward the inner path forming member and to appropriately curve the medium in the curved path.

A second aspect is an aspect dependent on the first aspect, and is characterized in that the inner path forming member in the curved path is provided with a first driven roller, the first driven roller being a roller having a portion protruding from the inner path forming member toward the outer path forming member and being configured to be driven to rotate, and a portion of the convex portion and a portion of the first driven roller overlap each other when viewed in a width direction intersecting the conveyance direction.

When a tip end of the medium is nipped by the second roller pair, the medium is conveyed along the inner path forming member, and thus the medium can be conveyed smoothly by providing the first driven roller that protrudes from the inner path forming member toward the outer path forming member. In particular, since a portion of the convex portion overlaps a portion of the first driven roller when viewed from the width direction intersecting the conveyance direction, it is possible to prevent the medium from coming into strong contact with the convex portion and to suppress an increase in a conveyance load.

A third aspect is an aspect dependent on the second aspect, and is characterized in that the first driven roller protrudes toward the outer path forming member beyond the convex portion when viewed in the width direction.

According to this aspect, since the first driven roller protrudes toward the outer path forming member beyond the convex portion when viewed in the width direction, it is possible to more reliably prevent the medium from coming into strong contact with the convex portion and to more reliably suppress an increase in a conveyance load.

A fourth aspect is dependent on the second aspect, and is characterized in that two of the guide members are provided in a width direction intersecting the conveyance direction, and the first driven roller is provided between the two guide members in the width direction.

According to this aspect, two of the guide members are provided in the width direction intersecting the conveyance direction, and the first driven roller is provided between the two guide members in the width direction, which makes it easier to stabilize the posture of the medium.

This aspect may also be dependent on the above-described third aspect, not only on the above-described second aspect.

A fifth aspect is an aspect dependent on the first aspect, and is characterized in that the guide member has an engagement hole, and the outer path forming member has an engagement protrusion that engages with the engagement hole.

According to this aspect, the guide member has the engagement hole, and the outer path forming member has the engagement protrusion that engages with the engagement hole, and thus the guide member can be easily fixed to the outer path forming member.

This aspect may also be dependent on any one of the above-described second to fourth aspects, not only on the above-described first aspect.

A sixth aspect is an aspect dependent on the fifth aspect, and is characterized in that the engagement protrusion includes a guide surface that guides the guide member in an engagement direction in which the engagement hole engages with the engagement protrusion, and a regulating surface that regulates movement of the guide member in a direction opposite to the engagement direction in a state where the engagement hole engages with the engagement protrusion.

According to this aspect, the engagement hole can smoothly engage with the engagement protrusion by the guide surface, and in a state where the engagement hole engages with the engagement protrusion, the regulating surface can reliably hold the guide member so that the guide member does not easily come off.

A seventh aspect is an aspect dependent on the first aspect, and is characterized in that the convex portion is constituted by a second driven roller that is driven to rotate.

According to this aspect, since the convex portion is constituted by the second driven roller that is driven to rotate, it is possible to suppress a conveyance load caused by the medium pressing against the convex portion.

This aspect may also be dependent on any one of the above-described second to sixth aspects, not only on the above-described first aspect.

An image reading device according to an eighth aspect is characterized in that it includes the medium conveyance device according to any one of the first to seventh aspects, and a reading unit that reads the medium conveyed by the medium conveyance device.

According to this aspect, the operational effect of any one of the first to seventh aspects described above can be obtained in the image reading device.

The present disclosure will be described in detail below.

An inkjet printer 100 shown in FIG. 1 is an example of a recording device that performs recording on a medium (not shown) and is equipped with an ink ejection head (not shown) inner side a printer body 101, the ink ejection head ejecting ink onto the medium. The ink ejection head is an example of a recording unit that performs recording on the medium. A medium storage cassette 103 is provided at the bottom of the printer body 101, and the medium is transmitted from the medium storage cassette 103 to a position facing the ink ejection head for recording. An operation panel 102 is provided on the front surface of the device and receives various operation settings by a user.

A scanner 1, which is an example of an image reading device, is provided at an upper portion of the printer body 101. That is, the inkjet printer 100 is a multifunction machine that has an image reading function of reading images of originals, in addition to a recording function of performing recording on the medium.

An X-Y-Z coordinate system shown in each drawing is a rectangular coordinate system in which a Y-axis direction is a depth direction of the device, a +Y direction of the Y-axis direction is a direction from the front surface of the device to the rear surface of the device, and a −Y direction is a direction from the rear surface of the device to the front surface of the device.

An X-axis direction is the width direction of the device, and when viewed from an operator of the inkjet printer 100, a +X direction is the left side and a-X direction is the right side. A Z-axis direction is a vertical direction, a +Z direction in the Z-axis direction is an upward direction, and a −Z direction is a downward direction.

In an original conveyance device 10, which is an example of a medium conveyance device to be described below, a Y-axis direction is the width direction of an original. In the original conveyance device 10, a direction in which the original is sent may be referred to as "downstream", and the opposite direction may be referred to as "upstream".

The scanner 1 includes a scanner main body 2 and the original conveyance device 10. The original conveyance device 10 is rotatably provided relative to the scanner main body 2 via a hinge (not shown), and rotates to open and close an original platen glass 41 (see FIG. 2) of the scanner main body 2. The hinge is provided at the rear of the device, and the rotation axis of the hinge is parallel to the X-axis direction, whereby the original conveyance device 10 rotates with the front side of the device as its free end.

The original conveyance device 10 includes an original placing part 3, and delivers an original P (see FIG. 2), which is an example of a medium placed on the original placing part 3, in the +X direction. The original P delivered from the original placing part 3 is curved downward, reversed, conveyed in the −X direction, and discharged towards a discharge tray 28.

Figure 2:
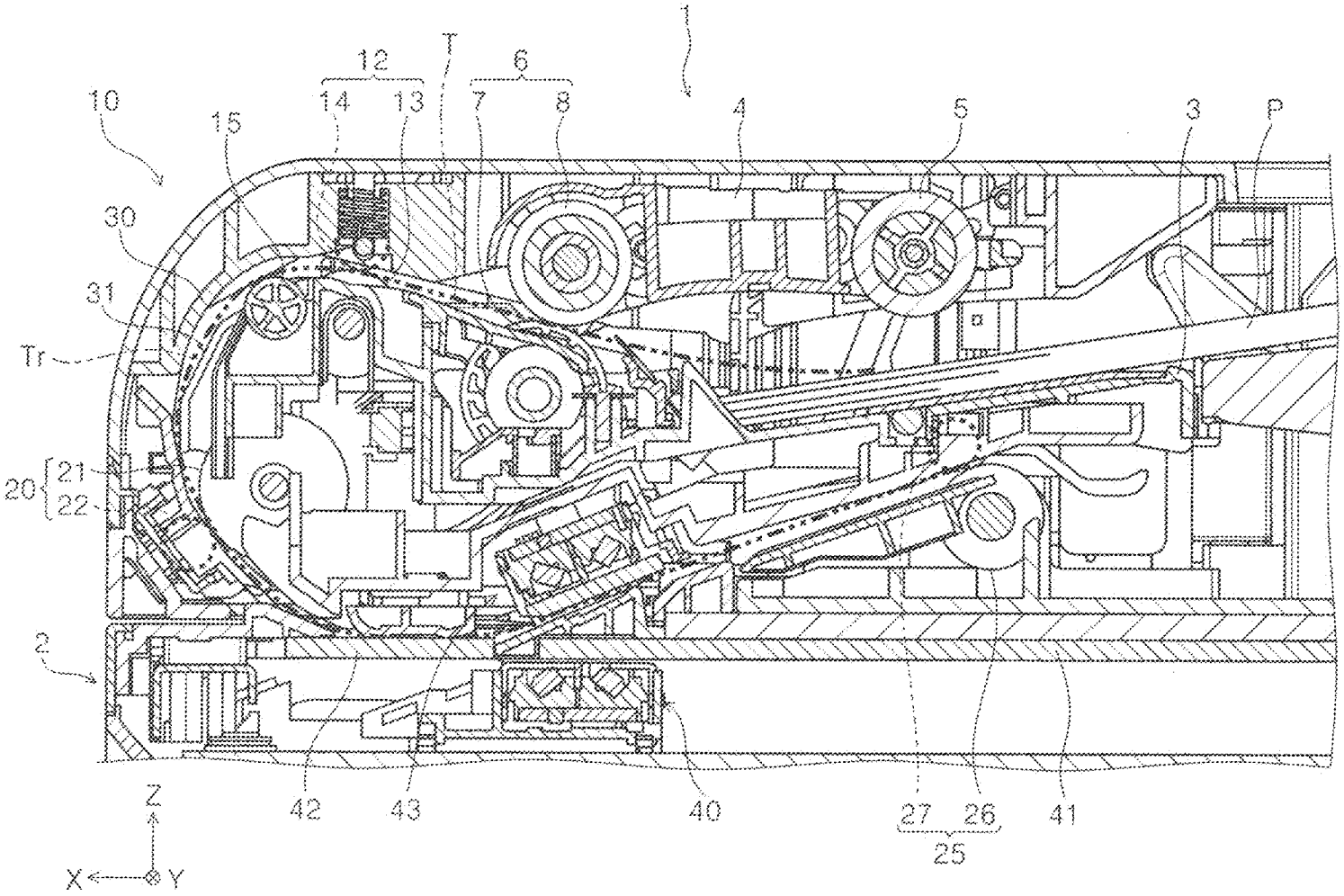
FIG. 2 is a cross-sectional view of an original conveyance device.

FIG. 2 shows an original conveyance path in the original conveyance device 10. In FIG. 2, the original conveyance path is indicated by an alternating two dots-dashed line with a sign T. The original conveyance path T is a path from a delivery roller 5 to a third roller pair 25, and includes a curved path Tr from a first roller pair 12 to a second roller pair 20.

The delivery roller 5 is provided at a position facing the original placing part 3, the delivery roller 5 feeding the original P placed on the original placing part 3. The delivery roller 5 is provided in a swinging member 4 that is swingable around the center of the rotation axis of a separation roller 8 to be described below, and moves forward and backward relative to the original P by the swinging of the swinging member 4. The delivery roller 5 is driven clockwise as shown in FIG. 2 by a motor (not shown).

A feed roller pair 6 is provided downstream of the delivery roller 5. The feed roller pair 6 includes a feed roller 7 that is driven counterclockwise as shown in FIG. 2 by a motor (not shown), and the separation roller 8 that nips and separates the original P between the separation roller 8 and the feed roller 7. The first roller pair 12 is provided downstream of the feed roller pair 6. The first roller pair 12 includes a first conveyance roller 13 that is driven counterclockwise as shown in FIG. 2 by a motor (not shown), and a first counter roller 14 that nips the original P between the first counter roller 14 and the first conveyance roller 13 and is driven to rotate.

The second roller pair 20 is provided downstream of the first roller pair 12. The second roller pair 20 includes a second conveyance roller 21 that is driven counterclockwise as shown in FIG. 2 by a motor (not shown), and a second counter roller 22 which nips the original P between the second counter roller 22 and the second conveyance roller 21 and is driven to rotate.

A first driven roller 15 which is driven to rotate is provided between the first roller pair 12 and the second roller pair 20. In particular, after the tip end of the original P is nipped by the second roller pair 20, the original P is pressed against the first driven roller 15, and thus the first driven roller 15 is driven to rotate in association with the conveyance of the original P. The first driven roller 15 is supported to be freely rotatable in an inner path forming member 31 to be described below.

The scanner main body 2 is located below the original conveyance device 10 and is equipped with a first reading unit 40. Each of the first reading unit 40 and a second reading unit 43 to be described below includes a contact image sensor (CIS), is elongated in the Y-axis direction, and read an image of the original P.

The first reading unit 40 is provided to be movable in the X-axis direction by a motor (not shown), and when the original P is placed on the original platen glass 41, the first reading unit 40 reads an image of the original P while moving in the X-axis direction below the original platen glass 41.

A guide glass 42 is provided in the +X direction relative to the original platen glass 41. When the image of the original P is read using the original conveyance device 10, the first reading unit 40 is disposed below the guide glass 42 and reads an image on a first surface of the original P being conveyed.

In the original P having passed through a position facing the guide glass 42, a second surface, that is, a surface opposite to the first side, is read by the second reading unit 43. The second reading unit 43 is fixedly provided with respect to the original conveyance device 10.

A third roller pair 25 is provided downstream of the second reading unit 43. The third roller pair 25 includes a third conveyance roller 26 that is driven clockwise as shown in FIG. 2 by a motor (not shown), and a third counter roller 27 that nips the original P between the third counter roller 27 and the third conveyance roller 26 and is driven to rotate. The original P is discharged to the discharge tray 28 (see FIG. 1) by the third roller pair 25.

Figure 3:
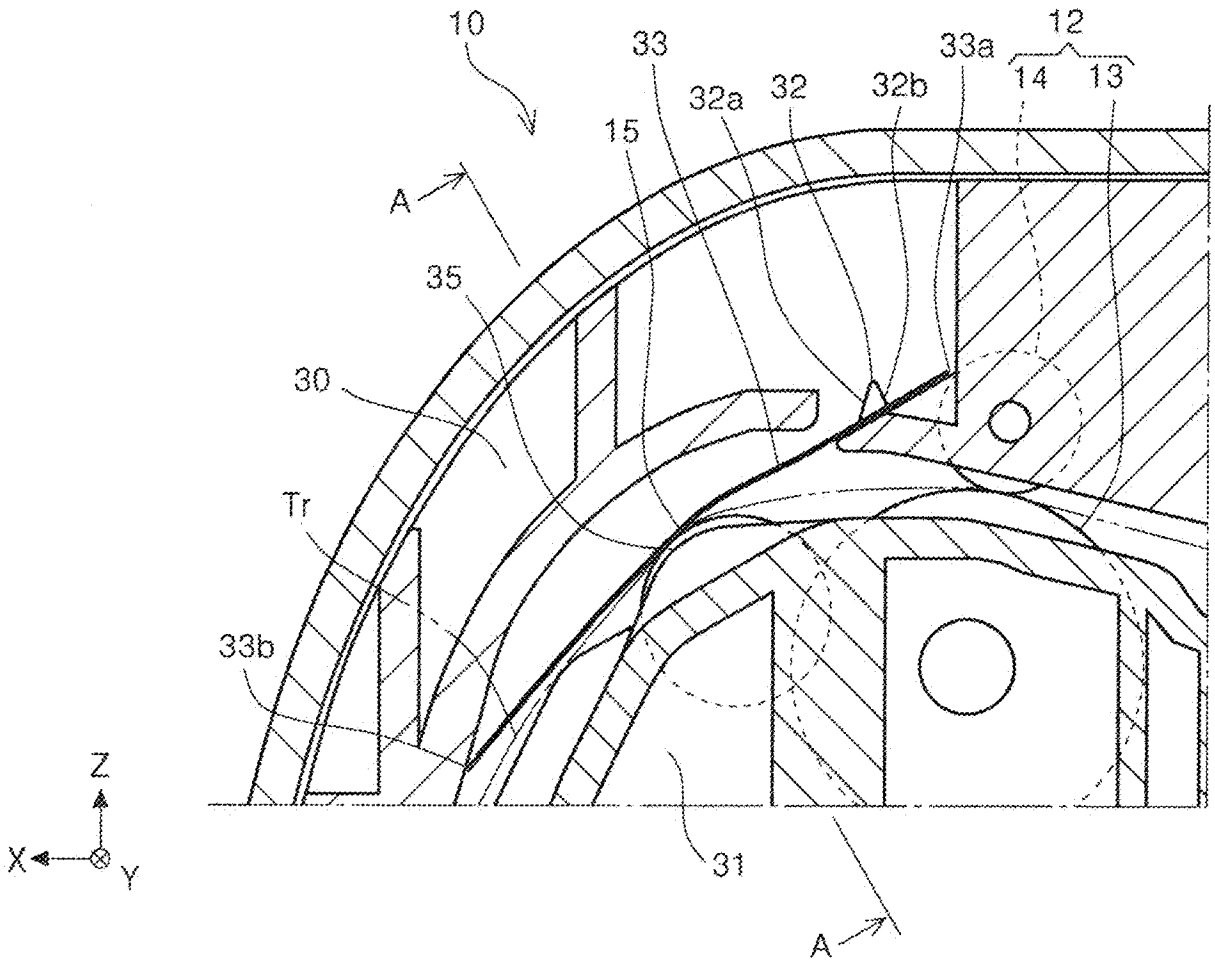
FIG. 3 is a cross-sectional view of the curved path with a guide member attached.

Next, a guide member 33 provided on the curved path Tr will be described. The guide member 33 is not shown in FIG. 2. As shown in FIG. 3, the outer side of the curved path Tr is formed by an outer path forming member 30, and the inner side of the curved path Tr is formed by the inner path forming member 31. The outer path forming member 30 is provided to be rotatable around a rotation axis (not shown), and rotates to move forward and backward relative to the inner path forming member 31. When the original P is jammed in the original conveyance path T, the jammed original P can be removed by rotating and opening the outer path forming member 30.

The outer path forming member 30 is provided with the guide member 33 that guides the original P on the curved path Tr. The guide member 33 is flexible. The guide member 33 can be formed by, for example, a polyethylene terephthalate (PET) sheet with a thickness of approximately 0.1 mm to 0.3 mm.

Figure 5:
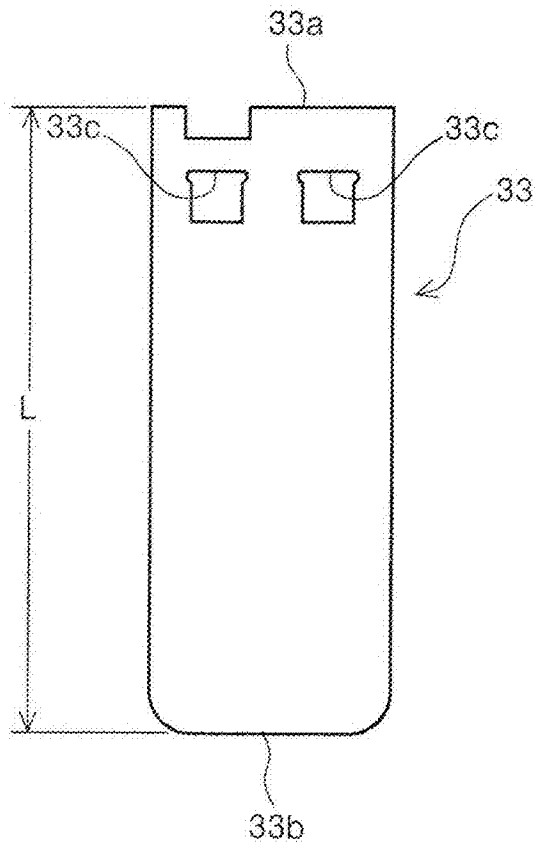
FIG. 5 is a plan view of the guide member.

FIG. 5 shows the shape of the guide member 33, and the guide member 33 has a fixed end 33*a* which is one end in the longitudinal direction, and a free end 33*b* which is the other end. A plurality of engagement holes 33*c* are formed near the fixed end 33*a* in the lateral direction intersecting the longitudinal direction. In this embodiment, two engagement holes 33*c* are formed.

As shown in FIG. 3, the fixed end 33*a* is fixed to the outer path forming member 30, and the free end 33*b* is disposed downstream of the fixed end 33*a* in an original conveyance direction.

Figure 4:
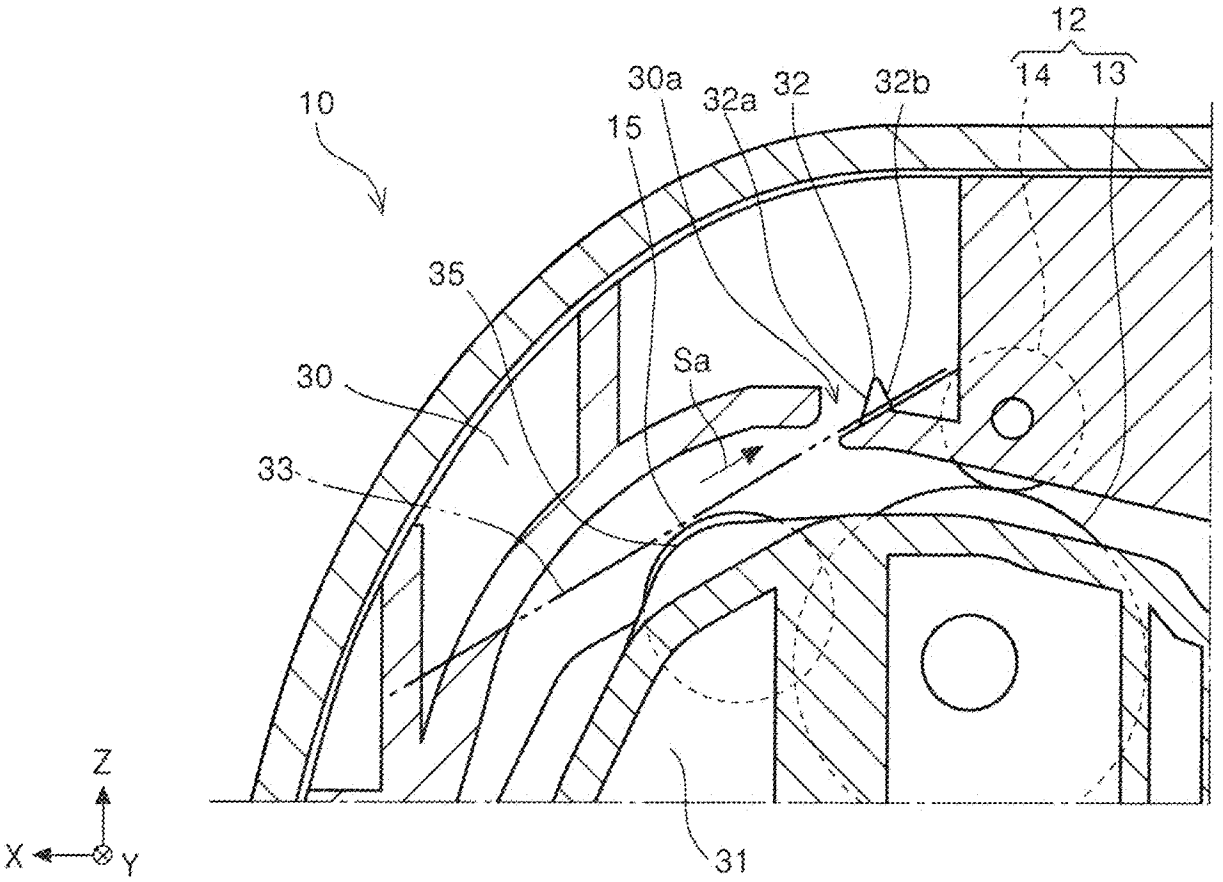
FIG. 4 is a cross-sectional view of a curved path without a guide member attached.
Figure 6:
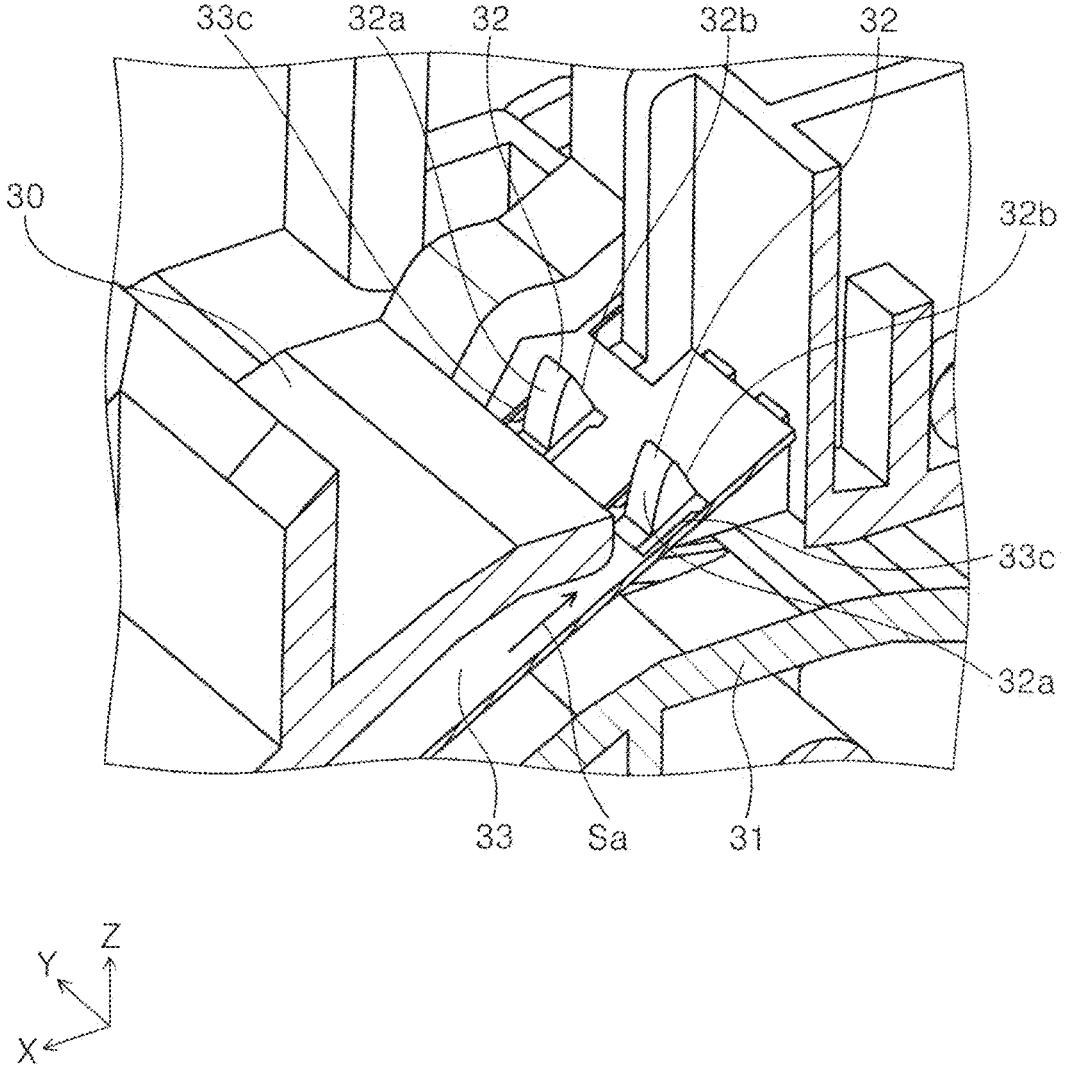
FIG. 6 is a perspective view of an engagement protrusion provided on an outer path forming member.

As shown in FIGS. 3, 4, and 6, the outer path forming member 30 is provided with an engagement protrusion 32, and the engagement hole 33*c* of the guide member 33 can engage with the engagement protrusion 32.

FIG. 4 shows a state where the guide member 33 is not attached, and a virtual line denoted by reference numeral 33 indicates the shape of the guide member 33 when the guide member 33 is not deformed and maintained in a linear shape. The engagement protrusion 32 has a guide surface 32*a* for guiding the guide member 33 in an engagement direction Sa in which the engagement hole 33*c* engages with the engagement protrusion 32, and a regulating surface 32*b* for regulating the movement of the guide member 33 in a direction opposite to the engagement direction Sa in a state where the engagement hole 33*c* engages with the engagement protrusion 32.

An opening 30*a* is formed in the outer path forming member 30, and the guide member 33 can be inserted into the outer path forming member 30 in the engagement direction Sa through the opening 30*a*. In this case, the fixed end 33*a* of the guide member 33 can ride over the engagement protrusion 32 by the guide surface 32*a*, and the engagement hole 33*c* can engage with the engagement protrusion 32 as shown in FIGS. 3 and 6. Furthermore, after the engagement hole 33*c* engages with the engagement protrusion 32, the regulating surface 32*b* holds the guide member 33 so that it does not easily fall off.

As described above, since the guide member 33 has an engagement hole 33*c*, and the outer path forming member 30 has the engagement protrusion 32 engaging with the engagement hole 33*c*, the guide member 33 can be easily fixed to the outer path forming member 30.

Furthermore, the engagement hole 33*c* can smoothly engage with the engagement protrusion 32 by the guide surface 32*a* of the engagement protrusion 32, and when the engagement hole 33*c* engages with the engagement protrusion 32, the regulating surface 32*b* can reliably hold the guide member 33 so that it does not come off easily.

The fixing of the guide member 33 to the outer path forming member 30 is not limited to the above, and the guide member 33 may be fixed with screws or the like or may be fixed with a double-sided tape, an adhesive, or the like.

Next, a length L of the guide member 33 (see FIG. 5) is set to a length such that the guide member 33 intersects the outer path forming member 30 when the guide member 33 is not deformed and maintained in a linear shape as shown in FIG. 4. Thus, when the guide member 33 is attached to the outer path forming member 30, the free end 33*b* of the guide member 33 comes into contact with the outer path forming member 30 as shown in FIG. 3, and the guide member 33 bends.

Here, a convex portion 35 is provided on the inner path forming member 31 at a position facing the guide member 33. Thus, even when the guide member 33 bends, the movement of the guide member 33 toward the inner path forming member 31 is limited to a position where it comes into contact with the convex portion 35. As shown in FIG. 3, when viewed in an original width direction, at least a portion of the convex portion 35 overlaps at least a portion of the first driven roller 15. In this embodiment, the convex portion 35 is provided integrally with the inner path forming member 31, but the convex portion 35 may also be formed separately from the inner path forming member 31 and then fixed to the inner path forming member 31.

Figure 7:
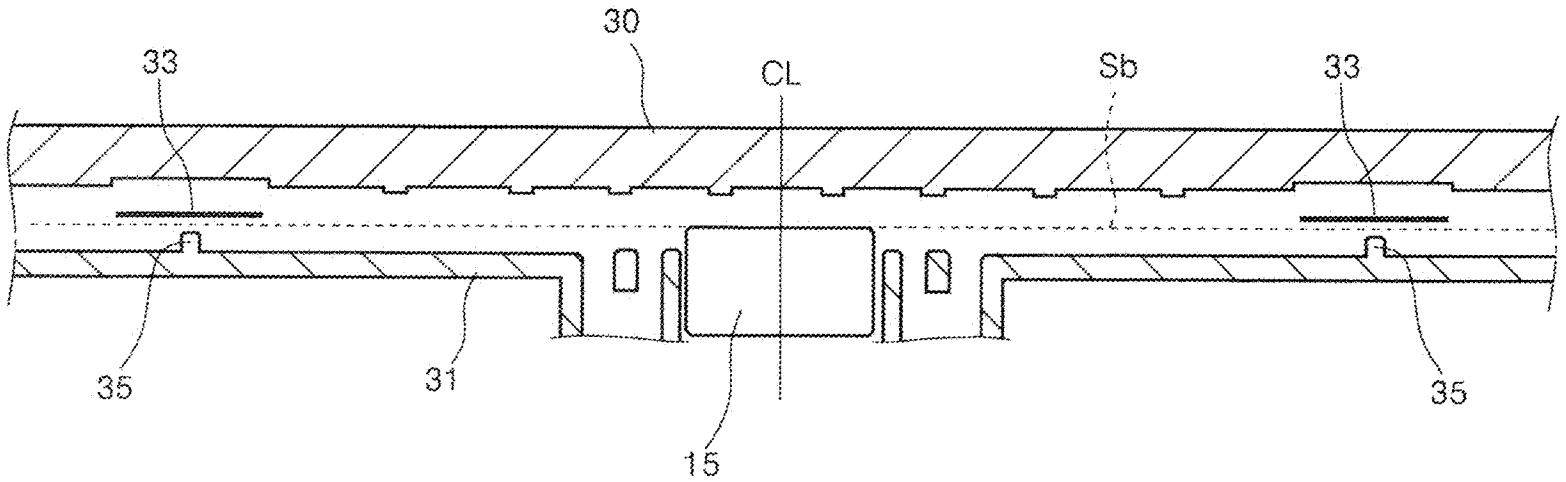
FIG. 7 is a cross-sectional view of the guide member and a convex portion.

FIG. 7 is a cross-sectional view taken along a line A-A shown in FIG. 3, and corresponds to a diagram in which the convex portion 35 and the guide member 33 are cut at a plane perpendicular to the guide member 33 indicated by an alternating two dots-dashed line in FIG. 4. In FIG. 7 and in FIGS. 8 and 9 to be described later, the guide member 33 is shown in a state before deformation as indicated by the alternating two dots-dashed line in FIG. 4.

In this embodiment, as shown in FIG. 7, a plurality of convex portions 35 are provided in the original width direction, specifically, two convex portions 35 are provided. In FIG. 7, a sign CL indicates the center position of the original P in the original width direction. The convex portion 35 and the guide member 33 sandwich a center position CL in the original width direction and are disposed at positions the same distance away from the center position CL. The first driven roller 15 is disposed at the center position CL. Thus, the convex portion 35 and the guide member 33 sandwich the first driven roller 15 in the original width direction and are disposed at positions the same distance away from the center position CL.

As described above, the original conveyance device 10 includes at least one flexible guide member 33 that guides the original P in the curved path Tr. One end of the guide member 33 is the fixed end 33*a* that is provided at the outer path forming member 30, and the other end of the guide member 33 is the free end 33*b* that is located downstream of the fixed end 33*a* in the original conveyance direction. The guide member 33 can prevent the entire rear end of the original P, that is, the entire rear end in the width direction, from coming into strong contact with the outer path forming member 30 when the rear end of the original P comes off from the rear end of the first roller pair 12, and thus it is possible to suppress contact noise generated due to the rear end of the original P which comes into strong contact with the outer path forming member 30. Here, when the guide member 33 excessively presses the original P toward the inner path forming member 31, the original P is deformed in a wavy manner in the width direction, thereby resulting in a concern that the original P cannot be curved smoothly in the curved path Tr. However, the inner path forming member 31 has the convex portion 35 that protrudes toward the guide member 33 at a position facing the guide member 33, and thus it is possible to prevent the guide member 33 from excessively pressing the original P toward the inner path forming member 31 and to appropriately curve the original P in the curved path Tr.

In addition, the inner path forming member 31 is provided with the first driven roller 15 which is a roller having a portion protruding from the inner path forming member 31 toward the outer path forming member 30 and which is configured to be driven to rotate, and a portion of the convex portion 35 and a portion of the first driven roller 15 overlap each other when viewed from the width direction, and thus it is possible to prevent the original P from coming into strong contact with the convex portion 35 and to suppress an increase in a conveyance load.

Furthermore, when viewed in the width direction, the first driven roller 15 protrudes toward the outer path forming member 30 beyond the convex portion 35. Thereby, it is possible to more reliably prevent the original P from coming into strong contact with the convex portion 35 and to more reliably suppress an increase in a conveyance load.

A dashed line Sb shown in FIG. 7 is a line passing through the top of the first driven roller 15 in FIG. 7, and the convex portion 35 does not protrude toward the guide member 33 beyond the dashed line Sb. However, the top of the convex portion 35 may be located at the position of the dashed line Sb.

Furthermore, the guide member 33 is not located on the convex portion 35 side beyond the dashed line Sb. However, the surface of the guide member 33 facing the convex portion 35 may be located at the position of the dashed line Sb, or the surface may be located on the convex portion 35 side with respect to the dashed line Sb.

Furthermore, in this embodiment, two guide members 33 are provided in the width direction, and the first driven roller 15 is provided between the two guide members 33 in the width direction. Thereby, the posture of the original P is easily stabilized.

Figure 8:
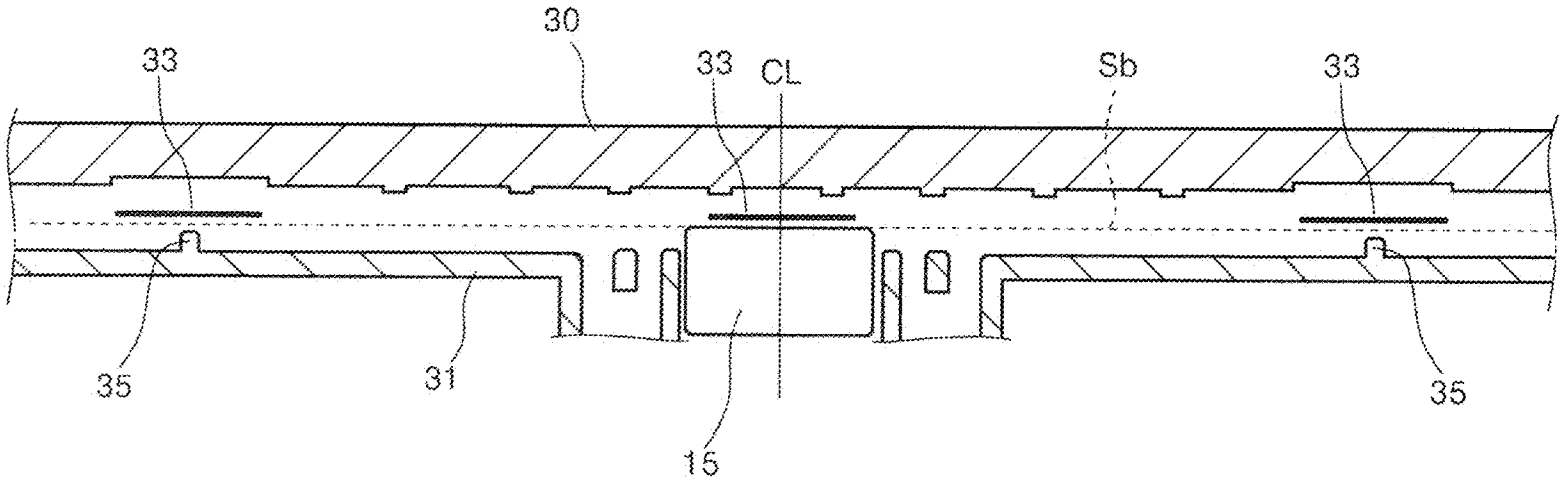
FIG. 8 is a cross-sectional view of the guide member and the convex portion.

The guide member 33 may also be disposed at a position facing the first driven roller 15 as shown in FIG. 8. Thereby, the posture of the original P is further stabilized. In this case, the posture of the original P is more stabilized by bringing at least the guide member 33 facing the first driven roller 15 into contact with the first driven roller 15.

Figure 9:
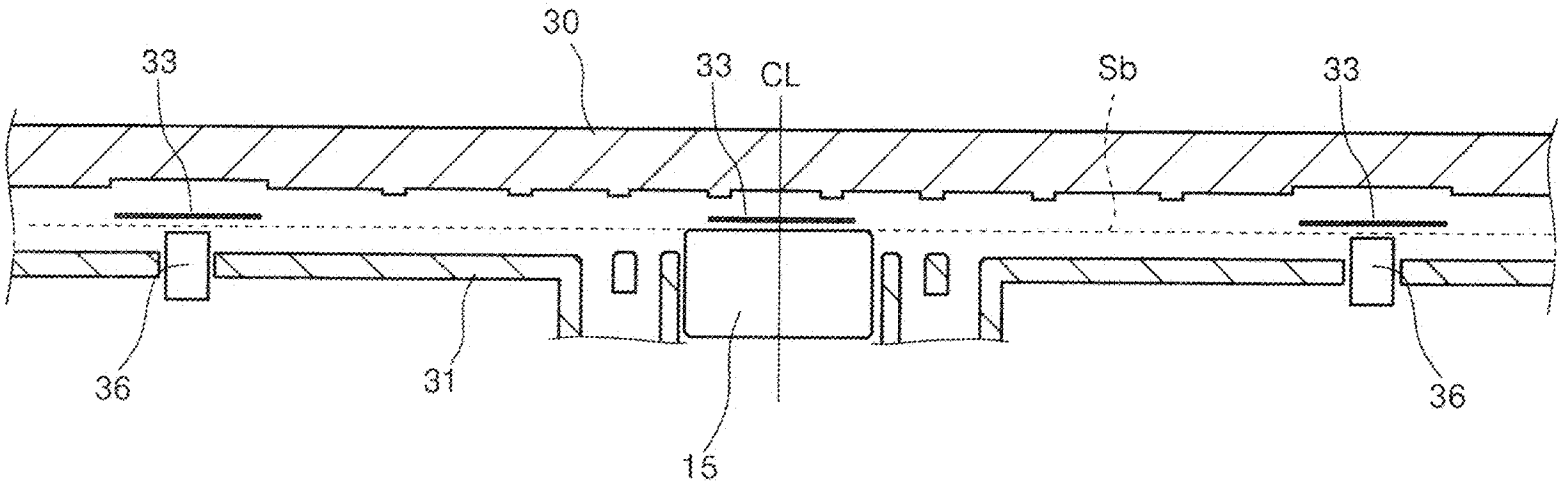
FIG. 9 is a cross-sectional view of the guide member.

In addition, the convex portion facing the guide member 33 may be constituted by a second driven roller 36 that is driven to rotate as shown in FIG. 9. Thereby, it is possible to suppress a conveyance load caused by the original P pressing against the convex portion facing the guide member 33. In this case, the height of the first driven roller 15 protruding toward the outer path forming member 30 is made equal to the height of the second driven roller 36 protruding toward the outer path forming member 30, and thus it is possible to prevent the original P from being deformed in a wavy manner in the width direction.

The present disclosure is not limited to the above-described embodiment, various modifications can be made within the scope of the disclosure as described in the claims, and it is needless to say that the modifications also fall within the scope of the present disclosure.

In particular, in the above-described embodiment, the guide member 33 and the convex portion 35 are applied to the original conveyance device 10 of the scanner 1, which is an example of an image reading device and is a device that conveys the original P, which is an example of a medium, but they may also be applied to a medium conveyance device that conveys a medium in the printer body 101.

What is claimed is:

1. A medium conveyance device including a medium conveyance path for conveying a medium in a conveyance direction, the medium conveyance device comprising:

a first roller pair that conveys the medium, the first roller pair comprising a first powered conveyance roller and a first counter roller;

a second roller pair that is provided downstream of the first roller pair in the conveyance direction and conveys the medium, the second roller pair comprising a second powered conveyance roller and a second counter roller, the second powered conveyance roller being an immediate next powered conveyance roller after the first powered conveyance roller, the second roller pair being lower than the first roller pair;

a curved path that is a path portion of the medium conveyance path from the first roller pair to the second roller pair and is curved such that a beginning of the curved path at the first roller pair is higher than an end of the curved path at the second roller pair;

an outer path forming member that forms an outer side of the curved path;

an inner path forming member that forms an inner side of the curved path; and at least one guide member that guides the medium in the curved path and is flexible, wherein one end of the guide member is a fixed end provided on the outer path forming member, and the other end of the guide member is a free end located downstream of the fixed end in the conveyance direction, and the inner path forming member has a convex portion that protrudes toward the guide member at a position facing the guide member, wherein the guide member has an engagement hole, and the outer path forming member has an engagement protrusion that engages with the engagement hole.

2. A medium conveyance device according to claim 1, wherein the inner path forming member in the curved path is provided with a driven roller that is driven by a medium under conveyance, the driven roller being a roller having a portion protruding from the inner path forming member toward the outer path forming member and being configured to be driven to rotate, and a portion of the convex portion and a portion of the driven roller overlap each other when viewed in a width direction intersecting the conveyance direction.

3. The medium conveyance device according to claim 2, wherein the driven roller protrudes toward the outer path forming member beyond the convex portion when viewed in the width direction.

4. The medium conveyance device according to claim 1, wherein the engagement protrusion includes a guide surface that guides the guide member in an engagement direction in which the engagement hole engages with the engagement protrusion, and a regulating surface that regulates movement of the guide member in a direction opposite to the engagement direction in a state where the engagement hole engages with the engagement protrusion.

5. The medium conveyance device according to claim 1, wherein the convex portion is constituted by a driven roller that is driven to rotate.

6. An image reading device comprising:

the medium conveyance device according to claim 1; and a reading unit that reads the medium conveyed by the medium conveyance device.

7. A medium conveyance device including a medium conveyance path for conveying a medium in a conveyance direction, the medium conveyance device comprising:

a first roller pair that conveys the medium, the first roller pair comprising a first powered conveyance roller and a first counter roller;

a second roller pair that is provided downstream of the first roller pair in the conveyance direction and conveys the medium, the second roller pair comprising a second powered conveyance roller and a second counter roller, the second powered conveyance roller being an immediate next powered conveyance roller after the first powered conveyance roller, the second roller pair being lower than the first roller pair;

a curved path that is a path portion of the medium conveyance path from the first roller pair to the second roller pair and is curved such that a beginning of the curved path at the first roller pair is higher than an end of the curved path at the second roller pair;

an outer path forming member that forms an outer side of the curved path;

an inner path forming member that forms an inner side of the curved path; and at least one guide member that guides the medium in the curved path and is flexible, wherein one end of the guide member is a fixed end provided on the outer path forming member, and the other end of the guide member is a free end located downstream of the fixed end in the conveyance direction, and the inner path forming member has a convex portion that protrudes toward the guide member at a position facing the guide member, wherein the inner path forming member in the curved path is provided with a driven roller that is driven by a medium under conveyance, the driven roller being a roller having a portion protruding from the inner path forming member toward the outer path forming member and being configured to be driven to rotate, a portion of the convex portion and a portion of the driven roller overlap each other when viewed in a width direction intersecting the conveyance direction;

the at least one guide member comprising two guide members that are provided in the width direction intersecting the conveyance direction, and the driven roller is provided between the two guide members in the width direction.

* * * * *